United States Patent [19]

Solheim

[11] Patent Number: 4,527,799

[45] Date of Patent: Jul. 9, 1985

[54] GOLF CLUB HEAD

[76] Inventor: Kasten Solheim, 501 Wakonda La., Phoenix, Ariz. 85023

[21] Appl. No.: 593,200

[22] Filed: Mar. 27, 1984

Related U.S. Application Data

[63] Continuation of Ser. No. 412,174, Aug. 27, 1982, abandoned.

[51] Int. Cl.[3] ..... A63B 53/04

[52] U.S. Cl. ..... 273/164; 273/183 D

[58] Field of Search ..... 273/163 R, 167 J, 175, 273/169, 183 R, 183 E, 183 D, 167 D, 164; D21/217, 218, 219

[56] References Cited

U.S. PATENT DOCUMENTS

| | | | |
|---|---|---|---|
| 2,520,950 | 9/1950 | Miller | 273/175 X |
| 3,085,804 | 4/1963 | Pieper | 273/164 X |
| 3,486,755 | 12/1969 | Hodge | 273/164 |
| 4,077,633 | 3/1978 | Studen | 273/164 |
| 4,367,877 | 1/1983 | Gibson et al. | 273/183 D X |

FOREIGN PATENT DOCUMENTS

| | | | |
|---|---|---|---|
| 9884 | of 1913 | United Kingdom | 273/167 J |

*Primary Examiner*—George J. Marlo

*Attorney, Agent, or Firm*—Freilich, Hornbaker, Rosen & Fernandez

[57] ABSTRACT

A putter is disclosed having a beveled portion (16, 16') on the face (13, 13') of its club head (10, 10') to leave a straight line of intersection (17, 17') that can be viewed for use as a reference even with the club head tilted forward while addressing a ball, and which, as viewed by the golfer, appears to be horizontal when either the toe or heel portion of the club is raised up from the putting surface.

3 Claims, 10 Drawing Figures

GOLF CLUB HEAD

This application is a continuation of application Ser. No. 412,174, filed 8/27/82, now abandoned.

BACKGROUND OF THE INVENTION

This invention relates to golf clubs, and more particularly to the head of a golf club used for putting on the green.

While using a putter on the green, a golfer usually positions himself very close to the ball, much closer than while using any other club to stroke a ball on a tee or the fairway. Some golfers will also press their hands forward somewhat in front of the ball. In other words, while addressing the ball, some golfers will tend to crouch close to the ball and tilt the club shaft slightly in the direction of the intended stroke. This causes the face of the club head to be tilted slightly forward with the result that the face may not be visible to the golfer, at least in the case of a putter having little or no loft. As a consequence of that tilt, the golfer will not have a reference for alignment of the club face except the upper edge of the club face. However, due to the club head being tilted forward, the upper edge may no longer be a true reference. This is particularly true of a putter having a face with an upper edge that inclines upwardly from heel to toe. Tilting such a putter forward will cause the upper edge of the club face to swing counterclockwise at the toe, even though the face is still properly aligned, i.e., square with the direction of the intended stroke. This swing of the upper edge causes the golfer to subconsciously correct the position of the head so that its upper edge will be square with the intended direction by turning the club head clockwise, thus opening the club face with the result that the stroke will be to the right of the intended direction.

Frequently a line that is perpendicular to the face of the putter is provided as a reference on a surface of the club that will be visible under all circumstances. While this line may be relied upon to some extent in squaring the club face with the intended direction for the ball, it is not as good a reference as the club face itself. This is so because such a line is usually much shorter than the length of the club face. Consequently, a small angle of misalignment will not be as easily noticed as when using the longer club face as a reference. It would be desirable to provide a reference on the club face that will be visible even while the golfer addressing the ball presses his hands forward.

SUMMARY OF THE INVENTION

In accordance with the present invention, a reference is provided on the face of a putter for use while addressing a ball by so beveling a significant upper portion of the club face through a small angle as to provide a line of intersection on the club face which extends substantially the full length of the club head. The slope of this line of intersection from heel to toe is set so that in addressing a ball the line will be horizontal, thus accommodating a golfer who addresses the ball with the club head flat by providing the line parallel to the sole, a golfer who addresses the ball the club head up at the toe by providing the line inclined downwardly from the heel to the toe, and a golfer who addresses the ball with the club head up at the heel by providing the line inclined upwardly from the heel to the toe. In each case, the line of intersection will appear horizontal to the golfer while addressing the ball.

BRIEF DESCRIPTION OF THE DRAWINGS

FIG. 1 is a perspective view, FIG. 2 is a plan view, FIG. 3 is a front elevation, FIG. 4 is a sectional view taken on a line 4—4 in FIG. 3 and FIG. 5 is a front elevation illustrating a variation in the first embodiment.

FIG. 6 is a perspective view, FIG. 7 is a plan view, FIG. 8 is a front elevation, FIG. 9 is a sectional view on a line 9—9 in FIG. 8 and FIG. 10 is a front elevation illustrating a variation in the second embodiment.

DESCRIPTION OF PREFERRED EMBODIMENTS

Figure 1:
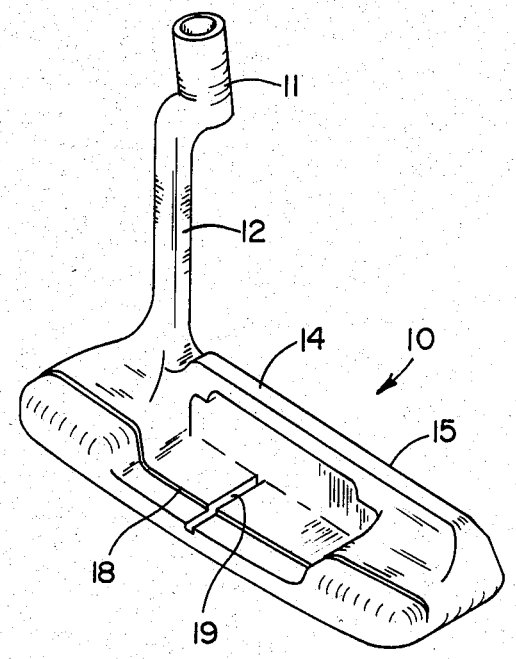
FIGS. 1–5 illustrate a first embodiment of the invention where

Referring now to the drawings, FIGS. 1–5 illustrate a club head 10 of a type which may be referred to as a blade putter. The club head is attached to a shaft (not shown) by a hosel 11. The hosel, and its particular location relative to the club head, is not a part of this invention. The particular configuration of the club head illustrated in U.S. Pat. No. Des. 207,227 is also not a part of this invention, but is nevertheless shown in full detail in order to illustrate an exemplary embodiment of the invention.

Figure 3:
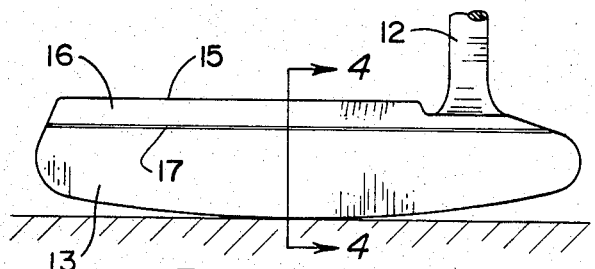
Figure 5:
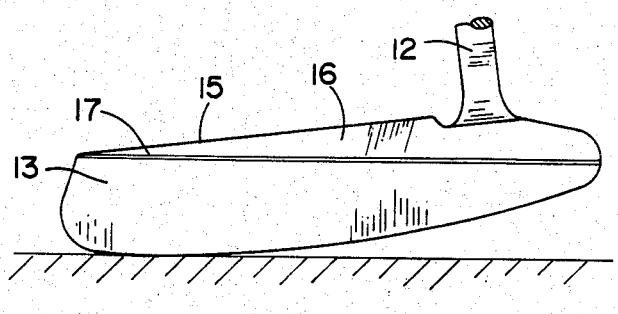

A characteristic feature of the club head is a stem 12 which positions the hosel 11 slightly ahead of the club face 13 (shown in FIG. 3) with its axis, and therefore the axis of the club shaft, passing in front of the center of the club face. Although not part of the present invention, it is useful to have the stem 12 as shown for an exemplary embodiment because it is vertical when the club head is flat, as shown in FIG. 3, and at a small angle from the vertical when the club head is not flat, such as when the club head is up at the heel, as shown in FIG. 5. This vertical stem may thus serve as a reference for the purpose of describing the present invention, even though such a vertical stem is not a part of the present invention.

The particular putter head chosen to illustrate the first embodiment of the invention also has a flat top surface 14 shown in FIG. 1 that provides an upper edge 15 that is substantially horizontal when the club head is flat, as shown in FIG. 3. In actuality the top may be inclined upwardly from heel to toe just enough to assure that the top appears to the golfer to be horizontal from his perspective when the club head is flat and not tilted forward. The top surface thus provides an edge useful as a horizontal reference, but only to the extent the upper surface is horizontal, and the club head is flat while addressing a ball. Any deviation of the upper surface from the horizontal, or of the club head from a flat position in addressing a ball, will introduce a directional error when using the edge 15 as a reference.

Figure 2:
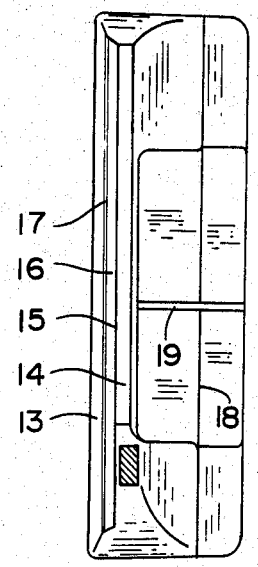

When the club head is placed behind the ball, i.e., when the club head addresses the ball, the full face 13 of the club head will be in view, very nearly as shown in the plan view of FIG. 2, provided the club head is not tilted forward, i.e., provided the golfer is not pressing his hands forward (in the direction of the hole). It can be appreciated that if he does press his hands forward, the club face 13 will disappear from view at some small tilt angle, leaving only the upper edge 15 as a reference, but only if it is very nearly horizontal as shown in FIG. 3. The problem which arises if the upper surface 14, and therefore the upper edge 15, is not horizontal will be better understood from a description of a second embodiment where that is the case. Rocking the club head back to place the toe high, or forward to place the heel high, while addressing the ball will have the effect of sloping the upper surface, such as shown in FIG. 5 for the case of the heel up. If the club head is now tilted forward, it will cause the upper edge to pivot clockwise about the toe. Because the effective pivot of the upper edge is very slight, the golfer will not be aware of it happening and may twist the club to bring the upper edge square with the intended direction of the stroke. As a consequence, the club face will be "closed" on addressing the ball, causing an error to the left in the direction that the ball is stroked.

Figure 4:
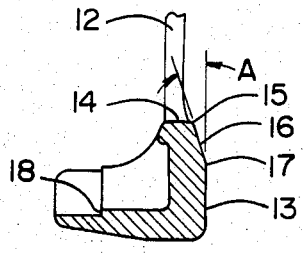

In order to provide a true reference that may be used, without introducing an error when the club head is tilted forward, the upper portion 16 of the club face 13 is beveled at a small angle A with respect to the face 13 as shown in FIG. 4, leaving a line of intersection 17 extending substantially the full length of the club head as shown in FIGS. 2 and 3. The bevel is, of course, chosen to be made with such an orientation relative to the club face 13 as to provide the line of intersection 17 with the desired horizontal orientation, which is parallel to the top edge 15 in the case of addressing the ball with the club head flat, i.e., with the stem 12 vertical and the top edge 15 parallel to the ground, as shown in FIG. 3. In the case of addressing the ball with the heel up, the bevel is made with such an orientation as to provide the line of intersection 17 inclined upwardly from heel to toe so that it will appear horizontal to the ground as shown in FIG. 5, just as in the case of addressing the ball with the club head flat. In the case of addressing the ball with the toe up, the bevel is made with such an orientation as to provide the line of intersection inclined opposite to that shown in FIG. 5 for the case of the heel up. In that manner, the club head may be customized for the particular putting style of a golfer who addresses the ball with the club head flat or in a position other than flat.

This first embodiment of the invention has in its design another line 18 (not part of this invention) shown in FIG. 2 that is a straight line parallel to the face as viewed when the club head is upright. Although such a line could be used for alignment while addressing a ball, it can be readily appreciated that the line is so remote from the club face, where the golfer focuses his attention, that it is not as effective a reference as a reference line at the face of the club head.

This first embodiment also illustrates the deficiency of a reference line 19 (also not part of this invention) which is perpendicular to the club face. Such a reference line is intended to be used to the club head while addressing a ball, but because it is so short, a slight twist of the club head is likely to go unnoticed, yet such a small error in direction could produce an error of a few inches at putting distances of several feet. A few inches in directional error will, of course, cause the ball to roll wide of its mark since the target (hole in the green) is only $4\frac{1}{4}$ inches in diameter. The line of intersection 17 between the club face 13 and its beveled portion 16 provides a much longer reference line at the face for more accurate use in aligning the club head.

Figure 7:
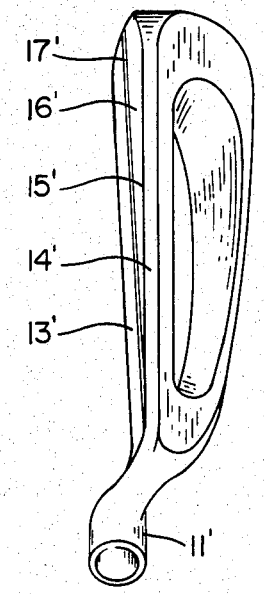
FIGS. 6–10 illustrate a second embodiment of the invention where
Figure 8:
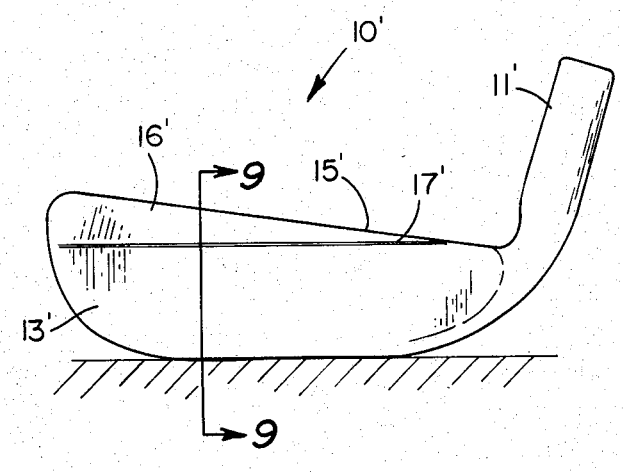
Figure 6:
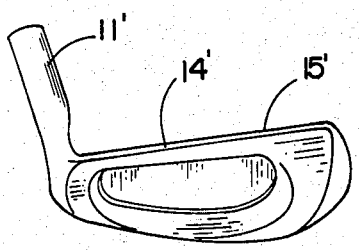
Figure 9:
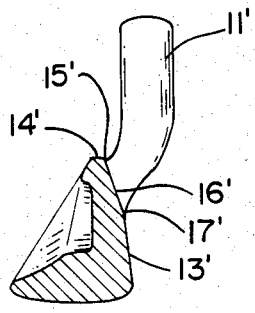

Referring now to FIGS. 6–10, there is illustrated a putter head which is also of the type commonly referred to as a blade, although the present invention is not limited to that type of putter. For convenience, the same but primed reference numerals will be used as in the corresponding views of FIGS. 1–5 of the first embodiment. Characteristic of this putter is that the top surface 14' is noticeably inclined from the heel to the toe, as shown in FIG. 8. As a consequence, the top edge 15' of the club face is seen by the golfer as being perpendicular to the intended direction of the stroke, which is normal to the club face, only when the club is held upright, as shown in FIG. 7. If the club head is tilted forward, the toe of the club head, i.e., the upper end of the club head opposite the hosel 11', will fall in the intended direction of the stroke and therefore pivot the upper edge 15' as though the club head were rotated counterclockwise about the axis of the hosel 11', i.e., as though the golfer had "closed" the club face slightly. The golfer may then subconsciously counteract that by rotating the club head clockwise, thus actually "opening" the club face to introduce an error to the right in the direction the ball is actually stroked.

It is thus evident that there may be a tendency to misalign the putter only because the top surface 14', and therefore the edge 15', slopes upwardly from the heel to the toe. To avoid that tendency, in accordance with the present invention, the upper portion of the club face is beveled to leave a horizontal line of intersection 17' on the club face. This line of intersection may then be used as a reference in addressing the ball, even while the club head is tilted forward as the golfer presses his hands forward, as long as that line of intersection is in view.

Figure 10:
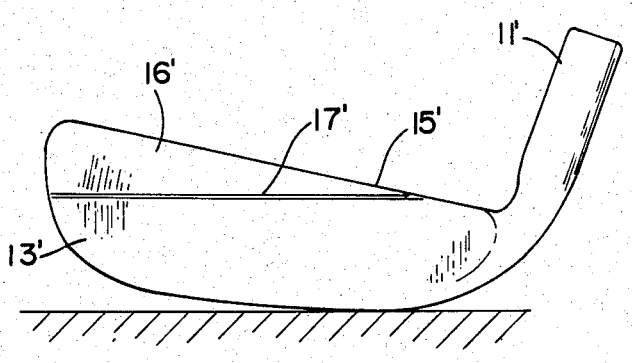

As in the first embodiment, the orientation of the bevel is chosen to provide the line of intersection 17' horizontal to the ground for the case of addressing the ball with the club head flat as shown in FIG. 8. For the golfer who addresses the ball with the toe (or heel) up, the orientation of the bevel is chosen to provide the line of intersection 17 sloping downwardly (or upwardly) from heel to toe relative to the sole of the club head when it is flat. This alternative is illustrated in FIG. 10 for the case of addressing a ball with the toe up. The case of addressing a ball with the toe down would be analogous to that illustrated in FIG. 5 for the first embodiment.

Although particular embodiments of the invention have been described and illustrated herein, it is recognized that the invention is not limited to these embodiments of the invention using blade putters. Consequently, it is intended that the claims be interpreted to cover the invention practiced in other styles of putters. It should also be noted that the need for having the line of intersection "substantially the full length of the club face should be construed broadly to include any substantial portion of the full length of the club head.

What is claimed is:

1. In a golf club head for a putter having a hosel and a ball striking face between a toe end and a heel end, with an upper edge that is straight over a significant upper portion of its length from the toe end to the heel end, an improvement comprised of a beveled portion of said face along the upper edge over at least a significant upper portion of the full length thereof to provide a straight line of intersection between the beveled portion and the face, said significant upper portion constituting a majority of the full length of said golf club head from head to toe, said line of intersection being visible to the golfer in using said head to putt a golf ball and oriented to be horizontal to the ground while the club head is held from the hosel in a predetermined position with a particular angle of lie while addressing a ball and said angle of lie being selected so that a plane tangent to the sole at the center thereof is in a non-horizontal position.

2. A golf club head as defined in claim 1 wherein said straight line of intersection is inclined upwardly from heel to toe relative to the horizontal when the club head is in a flat position with the approximate center of the sole of the club head tangent to a horizontal plane in order that said straight line of intersection be horizontal while the club head is positioned for addressing a ball with the heel up.

3. A golf club head as defined in claim 1 wherein said straight line of intersection is inclined downwardly from heel to toe relative to the horizontal when the club head is in a flat position with the approximate center of the sole of the club head tangent to a horizontal plane in order that said straight line of intersection be horizontal while the head is positioned for addressing a ball with the toe up.

* * * * *